US007487702B2

(12) United States Patent
Chen et al.

(10) Patent No.: US 7,487,702 B2
(45) Date of Patent: Feb. 10, 2009

(54) FOOD PRODUCT SLICER WITH REMOVABLE RING GUARD COVER

(75) Inventors: Shiyu Chen, Richmond Hill, GA (US); Shahram Shariff, Savannah, GA (US)

(73) Assignee: Premark FEG L.L.C., Wilmington, DE (US)

( * ) Notice: Subject to any disclaimer, the term of this patent is extended or adjusted under 35 U.S.C. 154(b) by 223 days.

(21) Appl. No.: 11/311,041

(22) Filed: Dec. 19, 2005

(65) Prior Publication Data

US 2007/0137447 A1 Jun. 21, 2007

(51) Int. Cl.
*B26D 7/22* (2006.01)

(52) U.S. Cl. ..... 83/546; 83/478; 83/DIG. 1

(58) Field of Classification Search ..... 83/546, 83/478, 544, 545, 860, 830, DIG. 1; 451/4, 451/45, 420
See application file for complete search history.

(56) References Cited

U.S. PATENT DOCUMENTS

| | | | | |
|---|---|---|---|---|
| 1,402,959 | A * | 1/1922 | Quinton | 83/546 |
| 1,449,832 | A * | 3/1923 | Nordin | 74/609 |
| 1,514,697 | A | 11/1924 | Gury | |
| 1,939,740 | A | 12/1933 | Van Berkel | |
| 2,141,055 | A | 12/1938 | Van Berkel | |
| 2,486,810 | A | 11/1949 | Van Duyn | |
| 2,563,120 | A * | 8/1951 | Klingens et al. | 83/94 |
| 2,598,739 | A * | 6/1952 | Zimmermann | 83/717 |
| 2,698,638 | A | 1/1955 | Foster | |
| 2,970,624 | A | 2/1961 | Lundell | |
| 3,809,870 | A | 5/1974 | Auble et al. | |
| 3,986,304 | A | 10/1976 | Shie, III | |
| 4,019,286 | A | 4/1977 | Spooner et al. | |
| 4,090,403 | A | 5/1978 | Tsukada et al. | |
| 4,178,797 | A | 12/1979 | Kozlowski, Jr. | |
| 4,186,634 | A | 2/1980 | Akczinski, Sr. | |
| 4,246,818 | A | 1/1981 | McGraw, Jr. | |
| 4,351,029 | A | 9/1982 | Maxey et al. | |
| 4,497,143 | A | 2/1985 | Mattei | |
| 4,685,364 | A | 8/1987 | Scheflow et al. | |
| 4,817,480 | A | 4/1989 | Young | |
| 4,962,581 | A | 10/1990 | Rutigliano | |
| 5,098,027 | A | 3/1992 | McClure et al. | |
| 5,144,773 | A | 9/1992 | Flores et al. | |
| 5,188,011 | A | 2/1993 | Somal et al. | |
| 5,209,025 | A | 5/1993 | Martin et al. | |
| 5,379,633 | A | 1/1995 | Flisram et al. | |
| 5,509,337 | A | 4/1996 | Norman et al. | |
| 5,591,072 | A | 1/1997 | Tweed et al. | |
| 5,609,512 | A | 3/1997 | Holmes et al. | |
| 5,626,065 | A | 5/1997 | Cattini | |

(Continued)

FOREIGN PATENT DOCUMENTS

DE 9416986 U1 12/1994

(Continued)

*Primary Examiner*—Boyer D Ashley
*Assistant Examiner*—Omar Flores-Sánchez
(74) *Attorney, Agent, or Firm*—Thompson Hine LLP

(57) ABSTRACT

A food product slicer with a rotatable slicer knife includes a ring guard disposed about a portion of the peripheral cutting edge of the slicer knife. A removable ring guard cover includes a food catching wall positioned in the gap between the peripheral cutting edge of the knife and the ring guard.

18 Claims, 3 Drawing Sheets

U.S. PATENT DOCUMENTS

| | | | |
|---|---|---|---|
| 5,860,343 | A | 1/1999 | Koch et al. |
| 6,123,449 | A | 9/2000 | Sadek-Patt |
| 6,591,157 | B1 | 7/2003 | Vivirito et al. |
| 6,709,319 | B2 | 3/2004 | Yan |
| 6,871,573 | B2 | 3/2005 | Mang |
| 7,134,937 | B1 | 11/2006 | Chen et al. |
| 2001/0018317 | A1 | 8/2001 | Yan |

FOREIGN PATENT DOCUMENTS

| | | | |
|---|---|---|---|
| EP | 1022101 | A2 | 7/2000 |
| EP | 1022101 | A3 | 5/2003 |

* cited by examiner

FOOD PRODUCT SLICER WITH REMOVABLE RING GUARD COVER

TECHNICAL FIELD

This application relates generally to food product slicers used for slicing bulk food products and, more specifically, to a food product slicer including a removable ring guard cover.

BACKGROUND

Food product slicers having circular slicer knives are commonly used in restaurant and grocery businesses, among others. It is common to provide a ring guard disposed about a portion of the knife cutting edge to protect the edge of the knife and it is preferred to have the ring guard mounted in a manner to prevent removal by the end user in order to assure the knife protecting function. Food product tends to be thrown off the rotating slicer knife onto the ring guard. U.S. Pat. No. 5,509,337 provides a slicer in which the ring guard is movable away from the plane of the knife cutting edge to facilitate cleaning. However, it would be desirable to provide a food product slicer that limits the need for cleaning the ring guard.

SUMMARY

In one aspect, a slicer for use in slicing a food product includes a slicer body and a circular slicer knife mounted to the slicer body for rotation and having a peripheral cutting edge. A carriage is mounted for moving food product back and forth past the circular slicer knife. A ring guard is disposed about the peripheral cutting edge along at least a portion of a non-cutting zone of the circular slice knife, leaving a gap between ring guard and the peripheral cutting edge. A ring guard cover includes a food catching wall positioned in the gap for catching food product thrown off the circular slicer knife toward the ring guard. The ring guard cover is removable for cleaning.

In another aspect, a method of limiting food product accumulation on a ring guard of a food product slicer is provided, where the food product slicer has a rotatable circular slicer knife with a peripheral cutting edge and the ring guard is positioned about at least a portion of a non-cutting zone of the circular slicer knife. The method includes the steps of: providing a gap between the peripheral cutting edge and the ring guard; providing a removable slicer component with a food catching wall sized to fit within the gap; and positioning the removable slicer component such that the food catching wall extends into the gap so as to be located between the peripheral cutting edge and the ring guard.

DETAILED DESCRIPTION

Figure 1:
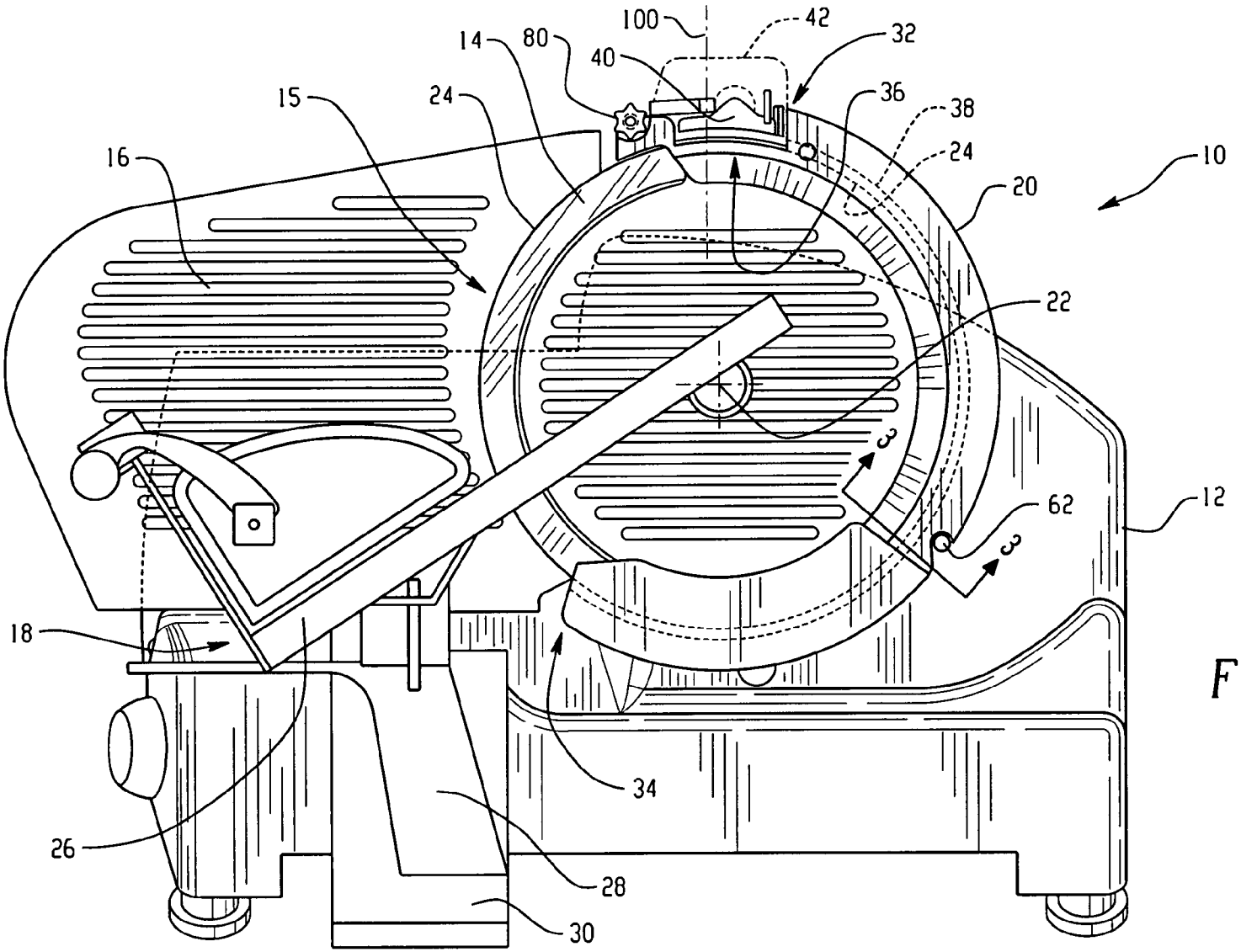
FIG. 1 is a side elevation of a food product slicer.

Referring to FIG. 1, a food slicing machine 10 includes housing 12 (often times also referred to as a base), circular slicing knife 14, gauge plate 16, product supporting carriage 18, and a cover plate 20. The housing may be consider part of the slicer body, which may include other portions such as castings. The circular slicing knife 14 is mounted to the housing for rotation about an axis 22 by a motor or other drive (not shown). A peripheral cutting edge 24 of the knife is exposed in a cutting region 15 of the knife that is proximate the gauge plate 16 (e.g., generally extending from approximately a seven o'clock position to an eleven o'clock position in the illustrated embodiment, with other variations possible). The gauge plate is movable transversely with respect to a plane defined by the peripheral edge 24 of the knife to control slice thickness, and can be located in a "zero" position wherein it is slightly raised above the cutting zone of the peripheral edge 24. The food product carriage 18 includes tray 26 mounted on support arm 28, which in turn may be pivotally mounted to a transport 30 that extends into the housing. The transport 30 is supported internal of the housing for linear, reciprocating movement back and forth past the slicer knife 14 in any suitable manner, variations of which are known in the art. Carriage movement may be implemented manually or automatically (e.g., as by a drive motor and belt system, hydraulics or other means). As food product is moved past the cutting edge of the knife in a slicing stroke, the food product on the tray 26 slides across the outwardly facing surface of the cover plate 20, which surface may be formed with raised ridges to improve slidability.

The illustrated cover plate 20 covers the peripheral cutting edge 24 of the slicer knife 14 from about a one o'clock position 32 to about a seven o'clock position 34. The peripheral cutting edge 24 is shown in shadow beneath the cover plate 20. In a twelve o'clock region 36 of the slicer knife 14, the cover plate diameter decreases to provide a space or opening at which the edge of knife can be sharpened. The cover plate 20 also extends over a ring guard 38 (only inner edge shown in shadow in FIG. 1) that is disposed about the peripheral cutting edge along at least a portion of the non-cutting zone of the circular slice knife, leaving a gap between ring guard and the peripheral cutting edge as shown. The ring guard may be fixed to the housing 12 in a stationary manner, or may be fixed to the housing to permit some movement for cleaning as described in U.S. Pat. No. 5,509,337. In either case, the ring guard is positioned to protect the cutting edge 24 of the slicing knife 14. In the illustrated embodiment, the ring guard 38 does not extend into the twelve o'clock zone 36 of the slicer knife, but such zone is provided with a knife guard member 40 that moves to permit sharpening by a sharpener assembly 42 (shown in dashed outline in FIG. 1). For example, knife guard member 40 may pivot about an axis 100 during sharpening. A small gap is provided between the knife guard member 40 and the peripheral edge 24 of the knife as shown.

Figure 2:
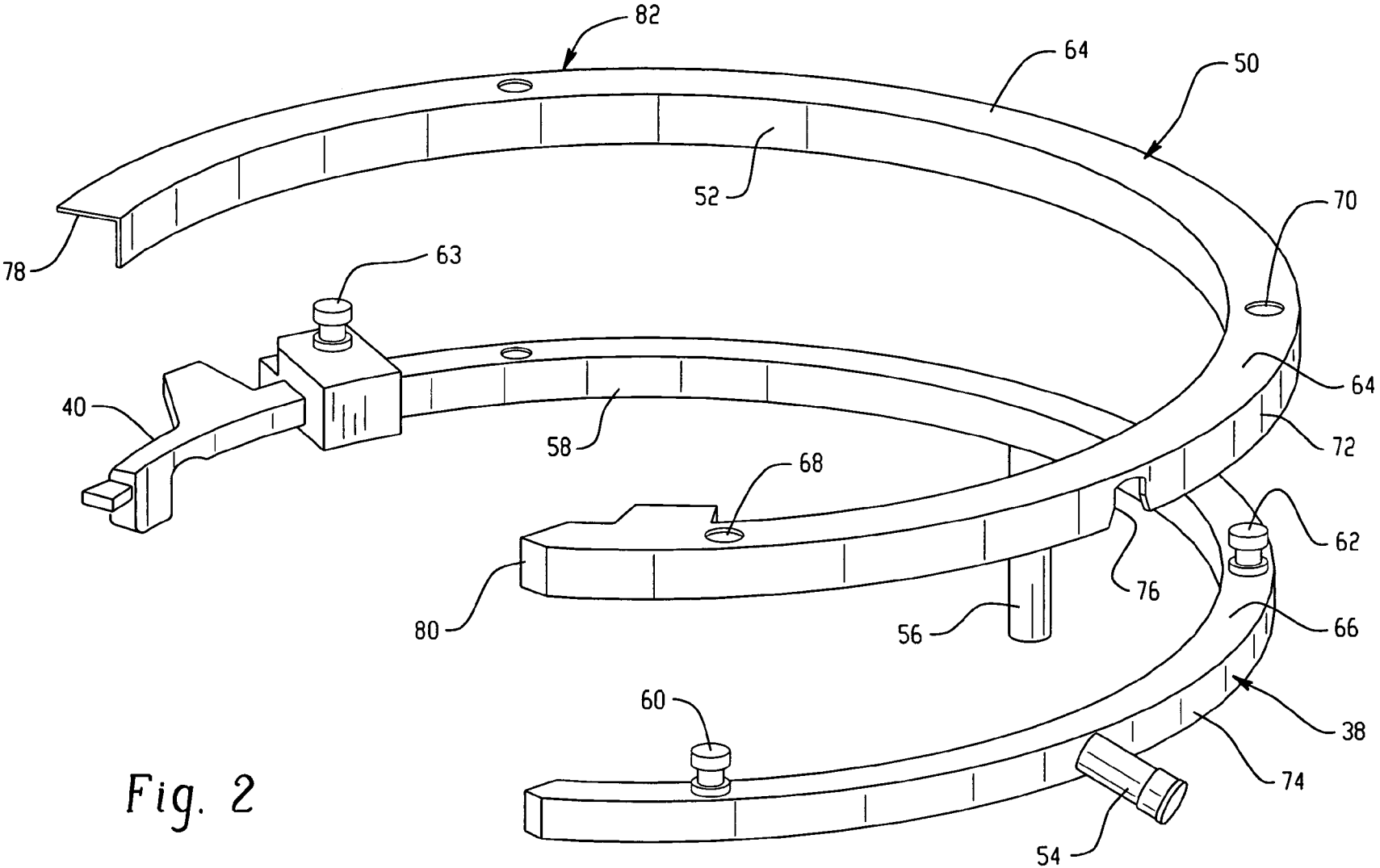
FIG. 2 is a partial perspective depicting a ring guard and a ring guard cover.

In order to limit food product being thrown off the knife 14 and onto the ring guard 38 and/or knife guard member 40, a removable ring guard cover (not shown in FIG. 1) is provided. Specifically, referring to FIG. 2, a perspective, exploded view showing ring guard 38, knife guard member 40 and a ring guard cover 50 is provided, with ring guard cover 50 in position spaced apart from the ring guard 38. The ring guard cover 50 includes a food catching wall 52 that is sized to fit within the gap between the peripheral cutting edge 24 of the knife and the ring guard. In the illustrated embodiment, the wall 52 extends circumferentially and forms a partial right circular cylinder, but variations are possible (e.g., complex curves and/or a wall with one or more flats).

The illustrated ring guard 38 has a generally rectangular cross-section, with outwardly extending mount post 54 and downwardly extending mount post 56 provided for mounting the ring guard 38 to the slicer housing, preferably in a manner to prevent its removal by an end user of the slicer. The ring guard cover also includes a radially inner surface 58, which in the illustrated embodiment extends circumferentially and forms a partial right circular cylinder, but variations are possible (e.g., complex curves and/or a surface with one or more flats). The illustrated ring guard 38 also includes tapered pins 60 and 62 for limiting movement of the ring guard cover 50 when the ring guard cover 50 is positioned with wall 52 within the gap between the knife edge and the ring guard 38. In particular, the illustrated ring guard cover 38 includes a wall 64 that joins wall 52, with wall 64 configured for overlaying ring guard surface 66 from which the pins 60 and 62 extend. Wall 64 includes mount openings 68 and 70 aligned for having pins 60 and 62 extend therethrough. An outer wall 72 of the ring guard cover 50 is configured to overlay an outer surface 74 of the ring guard 38. Outer wall 72 includes a slotted opening 76 aligned for positioning of mount post 54 therein. The combination of openings 68, 70 and 76 with pins 60 and 62 and post 54 prevents significant movement of the ring guard cover 50 relative to the ring guard 38, while at the same time enabling the ring guard cover 50 to be separated from the ring guard 38. Additional tapered pin 63 is also provided on ring guard 38 for use in securing the removable cover plate as will be explained in more detail below.

Notably, in the illustrated embodiment, inner wall 52 of the ring guard cover 50 extends to end 78, far enough to be positioned in the gap between the knife and movable knife guard member 40. Wall 64 of ring guard cover 50 is coextensive with wall 52. Outer wall 72 does not extend all the way to end 78 of the ring guard cover 50, so as to avoid interference with knife guard member 40 and knife sharpener 42 (see FIG. 1). Thus, ring guard cover 50 has a generally U-shaped cross-section along much of its length (e.g., from end 80 approximately to location 82), and has a generally L-shaped cross section from location 82 to end 78. However, it is recognized that variations to the cross-section of the ring guard cover 50 are possible.

Figure 3:
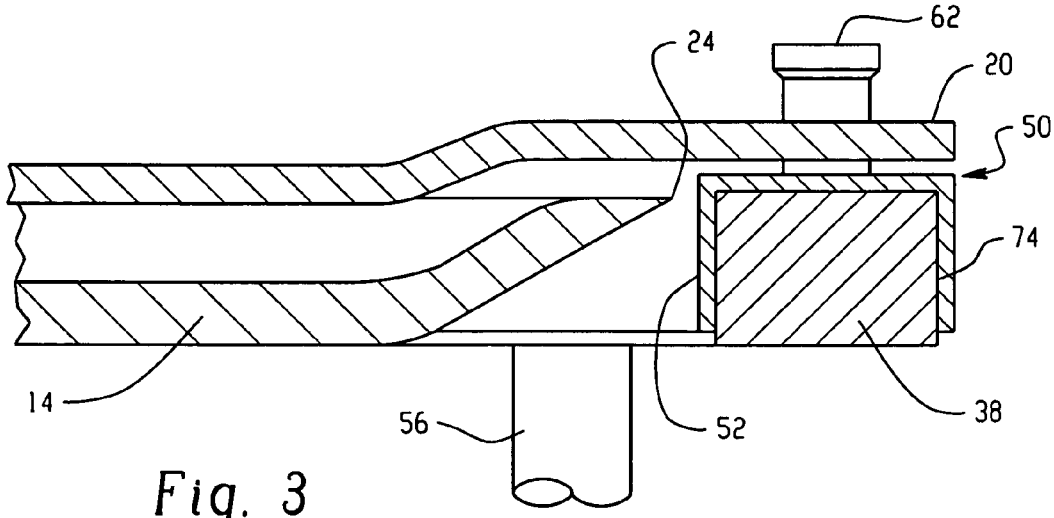
FIG. 3 is a partial cross-section along line 3-3 of FIG. 1.

Referring now to FIG. 3, a partial cross-section along line 3-3 of FIG. 1 is shown, depicting the cover plate 20, ring guard cover 50, ring guard 38 and outer portion of knife 14. As shown, wall 52 is positioned in the gap between the outer edge 24 of the knife 14 and the ring guard 38. Thus, as food product is thrown off the knife 14 radially outward during slicing operations, such food tends to collect on wall 52 rather than collecting on the ring guard 38. Because the ring guard cover 50 is removable, wall 52 can be more easily cleaned than the non-removable ring guard 38. While the wall 52 serves a food catching function, it need not be configured to prevent all food product from reaching the ring guard. For example, the wall might be configured such that is does not cover the entire extent of the gap between the knife edge and the ring guard. As shown, the edge portion of cover plate 20 overlays the ring guard cover 50 and holds it in place. In this regard, cover plate 20 may include openings for aligning with the tapered pins of the ring guard 38. Referring again to FIG. 1, the cover plate 20 may also include a manually actuated locking apparatus 80 for holding the cover plate in place. Such apparatus could, for example, be similar to that shown and described in connection with FIG. 4 of U.S. Pat. No. 5,509,337. Regardless, to remove the ring guard cover 50 for cleaning, the cover plate 20 is first removed, enabling the ring guard cover 50 to be pulled away from the ring guard 38 to be easily wiped down or carried to a sink or ware wash machine for cleaning. Wall 52 also extends into the gap between the knife guard member 40 (FIG. 1) and knife 14 in a manner similar to that shown in FIG. 3 relative to the ring guard 38, but without outer wall 74.

In one embodiment, the gap between the ring guard 38 and the outer edge 24 of the knife has a thickness of between about 0.100 inches and about 0.175 inches, and the food catching wall 52 of the ring guard cover has a thickness between about 0.030 inches and 0.080 inches, but variations are possible. The ring guard 38 may typically be formed of a metal, such as aluminum, while the ring guard cover 50 may typically be formed of plastic. However, variations in materials are also possible.

Figure 4:
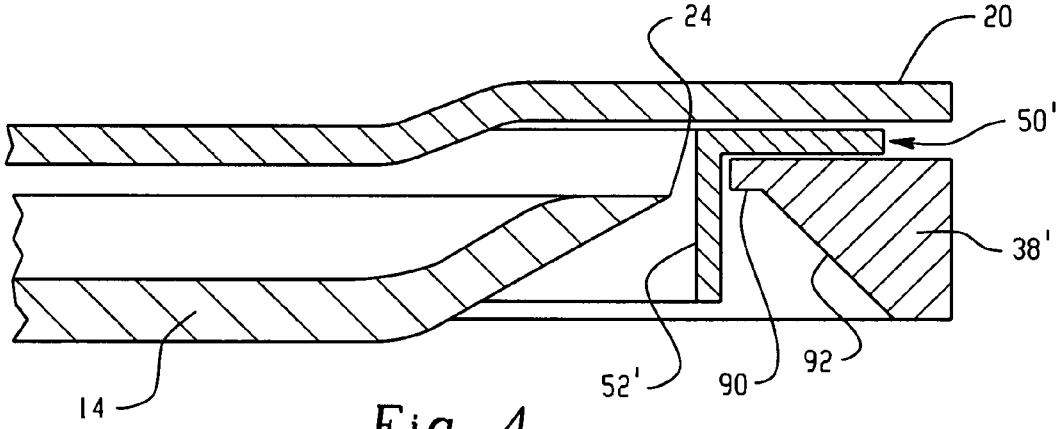
FIG. 4 is a partial cross-section of one alternative embodiment.

An alternative embodiment shown in the partial cross-section of FIG. 4 demonstrates a variation in position and shape of ring guard 38' and ring guard cover 50'. Specifically, the ring guard 38' lacks a rectangular cross-section, instead providing an inwardly extending lip 90, slightly offset from the plane of the knife cutting edge, and defining the desired radial spacing or gap from the outer edge of knife 14 to the ring guard, and a radially outwardly slanted surface portion 92. Food catching wall 52' is shown in the gap between the ring guard 38' and the outer edge 24 of the knife 14. Many other variations are possible.

Figure 5:
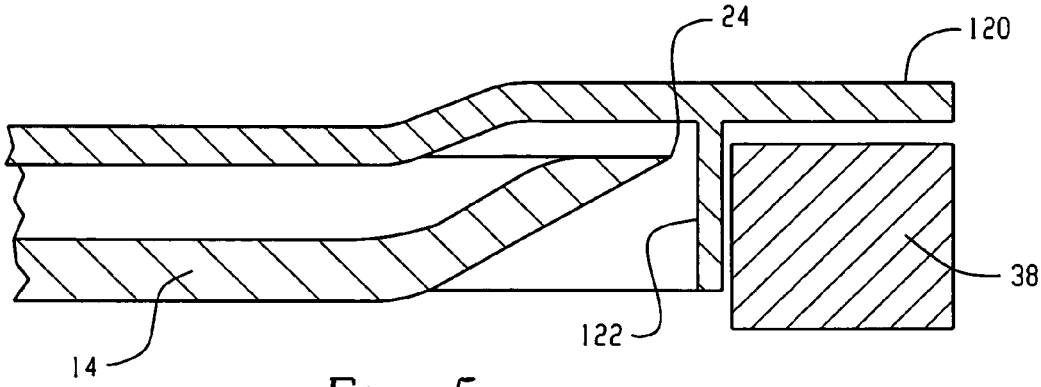
FIG. 5 is a partial cross-section of another alternative embodiment.

Referring now to FIG. 5, an embodiment providing the ring guard cover in combination with the cover plate is provided. Specifically, cover plate 120 includes a food catching wall 122 integral therewith and extending from the back or inward side of the cover plate 120 into the gap between the outer edge 24 of knife 14 and the ring guard 38.

It is to be clearly understood that the above description is intended by way of illustration and example only, is not intended to be taken by way of limitation, and that other changes and modifications are possible.

What is claimed is:

1. A slicer for use in slicing a food product, the slicer comprising:

a slicer body;

a circular slicer knife mounted for rotation relative to the slicer body, the slicer knife having a peripheral cutting edge;

a carriage mounted for moving food product back and forth past the circular slicer knife;

a ring guard disposed about the peripheral cutting edge along at least a portion of a non-cutting zone of the circular slice knife, a gap between ring guard and the peripheral cutting edge;

a ring guard cover including a food catching wall positioned in the gap for catching food product thrown off the circular slicer knife toward the ring guard, the ring guard cover removable for cleaning, wherein the ring guard cover is removable by movement in a direction outward from the slicer body and away from the ring guard while the ring guard remains in place.

2. The slicer of claim 1 wherein an upper portion of the non-cutting zone has a knife sharpening assembly located therealong, the food catching wall includes an upper portion positioned in a gap between the knife sharpening assembly and the peripheral cutting edge.

3. The slicer of claim 2 wherein a movable knife guard member is positioned adjacent the peripheral cutting edge of the knife proximate to the knife sharpening assembly, the upper portion of the food catching wall positioned between the movable knife guard member and the peripheral cutting edge.

4. The slicer of claim 2 wherein the ring guard has a rectangular cross-section, the ring guard cover has a u-shaped cross section in a region where it aligns with the ring guard, the ring guard cover has an L-shaped cross-section in a region where it aligns with the knife sharpening assembly.

5. The slicer of claim 1 wherein the ring guard cover is integrated into a cover plate that is positioned over an outwardly facing surface portion of the knife, the food catching wall extends from an interior side of the cover plate into the gap, an exterior side of the cover plate includes a food product slide face.

6. The slicer of claim 1 wherein a cover plate is positioned over at least portions of the ring guard cover, an exterior side of the cover plate includes a food product slide face, the cover plate aids in holding the ring guard cover in place and is removable.

7. The slicer of c1aim 1 wherein:

the ring guard includes a first portion aligned with the knife edge and located radially exterior the food catching wall and a surface portion facing outward from the slicer body;

the ring guard cover includes an overlaying portion extending radially outward from the food catching wall over and adjacent to the surface portion of the ring guard.

8. A slicer for use in slicing a food product, the slicer comprising:

a slicer body:

a circular slicer knife mounted for rotation relative to the slicer body, the slicer knife having a peripheral cutting edge;

a carriage mounted for moving food product back and forth past the circular slicer knife;

a ring guard disposed about the peripheral cutting edge along at least a portion of a non-cutting zone of the circular slice knife, a gap between ring guard and the peripheral cutting edge;

a ring guard cover including a food catching wall positioned in the gap for catching food product thrown off the circular slicer knife toward the ring guard, the ring guard cover removable for cleaning, wherein the ring guard includes a surface portion offset from and substantially coplanar with a plane defined by the peripheral cutting edge, the ring guard cover includes an overlaying portion adjacent the surface portion.

9. The slicer of claim 8 wherein the overlaying portion includes multiple openings therein, pins extending from the surface portion pass through the openings for limiting ring guard cover movement.

10. The slicer of claim 8 wherein the gap has a thickness of between about 0.100 inches and about 0.175 inches, and the food catching wall a thickness between about 0.030 inches and 0.080 inches.

11. A slicer for use in slicing a food product, the slicer comprising:

a slicer body;

a circular slicer knife mounted for rotation relative to the slicer body, the slicer knife having a peripheral cutting edge;

a carriage mounted for moving food product back and forth past the circular slicer knife;

a ring guard disposed about the peripheral cutting edge along at least a portion of a non-cutting zone of the circular slice knife, a gap between ring guard and the peripheral cutting edge;

a ring guard cover including a food catching wall positioned in the gap for catching food product thrown off the circular slicer knife toward the ring guard, the ring guard cover removable for cleaning, wherein the ring guard cover includes multiple openings therein, projections extending from the ring guard pass through the openings for limiting ring guard cover movement.

12. The slicer of claim 11 wherein at least one of the openings is a slot-type opening.

13. A slicer for use in slicing a food product, the slicer comprising:

a slicer body;

a circular slicer knife mounted for rotation relative to the slicer body, the slicer knife having a peripheral cutting edge;

a carriage mounted for moving food product back and forth past the circular slicer knife;

a ring guard disposed about the peripheral cutting edge along at least a portion of a non-cutting zone of the circular slice knife, a gap between ring guard and the peripheral cutting edge;

a ring guard cover including a food catching wall positioned in the gap for catching food product thrown off the circular slicer knife toward the ring guard, the ring guard cover removable for cleaning, wherein the ring guard includes a circumferentially extending surface aligned with the peripheral cutting edge and forming a partial right circular cylinder, the food catching wall extends circumferentially and forms a partial right circular cylinder.

14. A slicer for use in slicing a food product, the slicer comprising:

a slicer body;

a circular slicer knife mounted for rotation relative to the slicer body, the slicer knife having a peripheral cutting edge;

a carriage mounted for moving food product back and forth past the circular slicer knife;

a ring guard disposed about the peripheral cutting edge along at least a portion of a non-cuffing zone of the circular slice knife, a gap between ring guard and the peripheral cutting edge;

a ring guard cover at least partially surrounding the ring guard so that a portion of the ring guard cover is positioned in the gap for catching food product thrown off the circular slicer knife toward the ring guard, the ring guard cover removable for cleaning, wherein an upper portion of the non-cutting zone has a knife sharpening assembly located therealong, the ring guard cover includes an upper portion positioned in a gap between the knife sharpening assembly and the peripheral cutting edge, and wherein a movable knife guard member is positioned adjacent the peripheral cutting edge of the knife proximate to the knife sharpening assembly, the upper portion of the ring guard cover positioned between the movable knife guard member and the peripheral cutting edge.

15. The slicer of claim 14 wherein the ring guard includes a circumferentially extending surface aligned with the peripheral cutting edge and forming a partial right circular cylinder.

16. The slicer of claim 14 wherein the ring guard has a rectangular cross-section, the ring guard cover has a u-shaped cross section in a region where it aligns with the ring guard, the ring guard cover has an L-shaped cross-section in a region where it aligns with the knife sharpening assembly.

17. A slicer for use in slicing a food product, the slicer comprising:

a slicer body;

a circular slicer knife mounted for rotation relative to the slicer body, the slicer knife having a peripheral cutting edge;

a carriage mounted for moving food product back and forth past the circular slicer knife;

a ring guard disposed about the peripheral cutting edge along at least a portion of a non-cutting zone of the circular slice knife, a gap between ring guard and the peripheral cutting edge; and a ring guard cover including a food catching wall positioned in the gap for catching food product thrown off the circular slicer knife toward the ring guard, the ring guard cover removable for cleaning; wherein the ring guard includes a first portion aligned with the knife edge and located radially exterior the food catching wall and a surface portion facing outward from the slicer body; and the ring guard cover includes an overlaying portion extending radially outward from the food catching wall over and adjacent to the surface portion of the ring guard.

18. The slicer of claim 14 wherein a cover plate is positioned over at least portions of the ring guard cover, an exterior side of the cover plate includes a food product slide face, the cover plate aids in holding the ring guard cover in place and is removable.

* * * * *